United States Patent [19]

Van der Werff

[11] Patent Number: 4,636,157

[45] Date of Patent: Jan. 13, 1987

[54] TOROIDAL MOTOR OR PUMP

[76] Inventor: Jeichienus A. Van der Werff, Onder de Boompjes "Quo Vadis", 3417 ZG Montfoort, Netherlands

[21] Appl. No.: 694,987

[22] Filed: Jan. 25, 1985

[30] Foreign Application Priority Data

Jan. 26, 1984 [NL] Netherlands ..... 8400246

[51] Int. Cl.[4] ..... F03C 4/00; F04C 18/00

[52] U.S. Cl. ..... 418/225; 418/125; 418/226

[58] Field of Search ..... 418/225–227, 418/112, 116, 125

[56] References Cited

U.S. PATENT DOCUMENTS

| | | | |
|---|---|---|---|
| 3,867,075 | 2/1975 | Horst | 418/226 |
| 4,082,485 | 4/1978 | Sommer | 418/227 |
| 4,167,933 | 9/1979 | Slanhoff | 418/227 |
| 4,200,084 | 4/1980 | Alexeev | 418/226 |

FOREIGN PATENT DOCUMENTS 1209908 1/1966 Fed. Rep. of Germany .

269617 5/1927 United Kingdom .

*Primary Examiner*—Carlton R. Croyle
*Assistant Examiner*—Jane E. Obee
*Attorney, Agent, or Firm*—Fleit, Jacobson, Cohn & Price

[57] ABSTRACT

Toroidal motor or pump comprising a toroidal cylindrical casing with a disc rotor containing rotatably mounted vanes which are able to seal off the cylinder. On the shaft of the vanes rockers are fixed which during rotation of the motor/pump cooperate with a curved disc, which casing possesses a restricted section in the shape of the disc rotor through which the vanes in closed position are able to pass, as well as an inlet and outlet port for a pressure medium in the section wherein the vanes are rotating. To guarantee smooth operation between the casing halves and the disc rotor two complementary twin axially curved discs are arranged between which the rockers run, said rockers having the general shape of a central cam with two side cams so that they are able to move through the disc rotor. The restriction is so constructed that the vane in its passing position is not turned a complete 90°, but about 85°.

9 Claims, 5 Drawing Figures

TOROIDAL MOTOR OR PUMP

The invention relates to a toroidal motor or pump comprising a toroidal cylindrical casing provided with a disc rotor, wherein vanes are rotatably mounted which are able to seal off the cylinder, wherein on the shafts of the vane rockers are fixed rockers which during rotation of the motor cooperate with a curved disc, which toroidal cylindrical casing possesses a narrowed section in the shape of the disc rotor and wherein the vanes in closed position are able to pass, there further being present an inlet and outlet port for a pressure medium in a section where the vanes are rotatable.

Such a device is disclosed in the British Patent Specification No. 269,617 wherein it further is indicated that the swinging movement of the vanes about an axis which is radial in respect of the axis of rotation of the rotor is effected by a curved disc with which the internal shafts of the vanes are cooperatively connected through the rockers. This curved disc consists of a cylindrical device with a circumferential curved groove lying coaxially inside said driving shaft and which is supported by said annular room chamber or a part thereof, the vanes being cooperatively connected with the curved disc. This device has the objection that the curved disc as used with the corresponding rocker, as shown in FIG. 1 of that reference by reference numbers 26 and 38, is easily jammed because the lever of the rocker is too small. This gives rise to sealing problems leading to loss of pressure by which the efficiency of the motor is considerably reduced. With a view thereof, a relatively large number of vanes is used, i.e. six, which however has the drawback that the construction is too complicated. As far as applicant knows such a type of toroidal motor/pump has never been used in practice. In later publications such as the German PS No. 1209908 and the British PS Nos. 269617 and 16144, improvements of the construction of the curved disc are proposed but however no smooth fluent movement of the rocker therewith is obtainable, so that the above mentioned essential problems were not completely overcome. With the known constructions, further, the problem exists that the toroidal motor/pump can only rotate in one direction.

The present invention has an objective to provide a toroidal motor/pump with an improved curved disc mechanism and rockers with a long lever by which the rotary movements of the vanes proceed gradually and without any difficulty, and thus no sealing problems occur. It is another object of the invention to equalize the forces exerted on the vanes by means of bearings so that thereby an increased life is guaranteed. It is a further object of the invention to provide a toroidal motor/pump of the aforementioned type wherein in reversing the inlet and outlet parts the rotation movement can be reversed. It is another object of the invention to give the toroidal motor/pump a symmetrical construction by which as well a symmetrical division of forces and thus a smooth working and extended life is reached.

Thus the aforementioned toroidal motor/pump according to the present invention is characterized in that between the toroidal cylindrical casing halves and the disc rotor are two complementary shaped twin axial curved discs, as illustrated in FIGS. 2 to 5 of the drawings, are arranged between which the rockers run, said rockers having the general shape of a central cam with two side cams shaped so that the rockers can be moved through the disc rotor. The above embodiment leads to a smooth rotary movement of the vanes, while if necessary the rotation movement can be reversed. The rockers are made so that at any particular moment they can be taken up from one curved track on the other curved track. By providing a complementary arranged twin axial curved disc and specially shaped rocker, such as illustrated in more detail in FIG. 3 of the drawings, the rockers, which move in the plane of the rotor disc, nowhere in their movement will be blocked and can always be controlled by a curved track. In principle any number of vanes can be chosen but preferably one will chose the least possible number to minimize wear and friction. Practically, it is preferred to use 3 vanes, by which the desired effect is reachable with a minimum number of vanes.

In a special embodiment the construction is made so that the vanes with rockers do not rotate over the total 90° from the sealing position of the vanes within the toroidal casing to the position wherein the vanes are lying in the plane of the disc rotor. It suffices to use a maximum angle of rotation which may be lower by several degrees, as is practically possible, which value preferably is about 5°. If the value in degrees is too large, the construction will become more difficult while with a few degrees the effect thereof will be negligible.

It has been found that about 5° is a suitable value because without substantial changes in the construction the total angle of rotation of the vanes may be less with twice the amount of 5°. This has the effect that the curve is made smoother while further two additional walls can be arranged in the curved discs to define a cam track by which the opening between the toroidal casing valves to receive the rotor disc with the vanes substantially aligned with the surface of the rotor disc may be made smaller, which has the advantage that the arc length of that opening can be made shorter and thus the rotation time while the vanes are operative may be made longer. This last facilitates a further smooth working and reduces the possibility that the rockers get jammed.

The vanes are provided with an additional central bearing which engages the center of the vane and is connected in the disc rotor. By this construction the maximum force exerted on the vanes in the sealed condition is distributed over the vane. Further the vanes are preferably circumferentially provided with annular joints which ensure a lasting sealed condition of the cilinder casing space over the range when the vanes are standing still in the sealed position.

The toroidal motor works according to the principle that when a pressure medium is connected to the cilindrical casing in the sealed position of the vanes a force is applied on the vanes causing the disc rotor to rotate; there must be present a separation section between the inlet and outlet ports. At a certain time of its circular track the vane must be rotated without pressure on the vane.

To continue the periodical movement, the vane must again return to its original position and thus passes through the restricted separation space. The vanes therefore have to carry out a rotary movement from, on the one hand, the sealed position wherein they are in a vertical position in respect of the plane of the disc rotor, to the opened position wherein they have to lie in the plane of the disc rotor in order to pass through the restricted section. In such a system one can use a pressure medium which may be a liquid as well as a gas, and wherein macro as well as micro movements are possible. It is understood that the periodical movement of the vanes depends on the particular construction, but as indicated in FIG. 3, in a suitable embodiment the division is as follows: 150° resting position, wherein the vane seals off the cilindrical space, 70° rotation wherein the vane is rotating from the sealing position into the position that it can pass through the restriction, resting position 70°, the vane is passing through the restricted section, rotation 70° wherein the vane returns to its sealing position and thus again starts the 150° operative condition.

The construction of the invention enables a smooth operation of the rotary movement of the vanes with the aid of a twin complementary axial curved disc in combination with the rocker with more cams, so that shocks are prevented and the life expectancy of the motor is increased. Furthermore sealing problems because of these smooth rotary movements are strongly reduced.

The invention will now be illustrated with the following drawings of which

FIG. 2 is a section 2—2 according to FIG. 1, while

FIG. 3 is a 360° longitudinal section of the disc rotor in flattened position, which illustrates the position of the vanes in the various stages, while

In the following description of the various figures the same reference numerals refer to the same parts.

Figure 1:
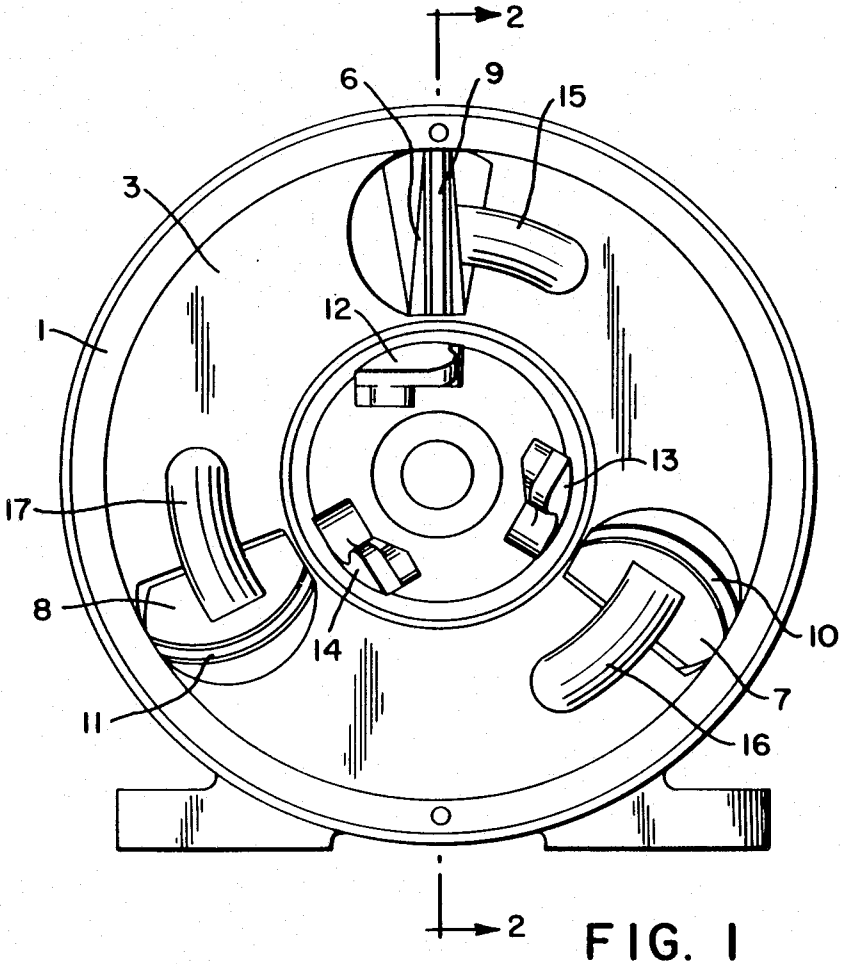
FIG. 1 is a view of the motor/pump with a toroidal cylindrical casing.
Figure 2:
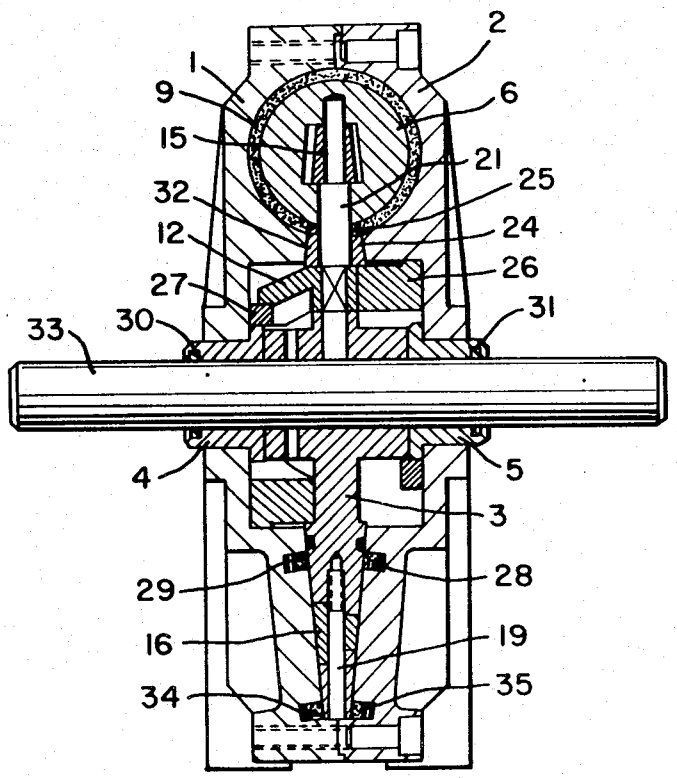

In the drawing figures the toroidal motor according to the invention is illustrated. Three vanes (6, 7 and 8) which are rotatably supported in the disc rotor (3) are fixed to shaft 33. The vanes are provided with supporting bearings (15, 16, 17), rotatable around the vane axes (21, 22, 23) and connected to the disc rotor (3) by means of connecting pins (18, 19, 20), see FIG. 3. The vanes are provided with sealing annular springs (9, 10, 11). In FIG. 1 in the central circle the rockers (12, 13, 14) with two outer cam followers are indicated, which run over and between the curved discs 26 and 27. Below the vanes are axial sealing rings 24 and 32 (drawn for one vane in FIG. 2). Furthermore an annular seal 25 is present.

Figure 3:
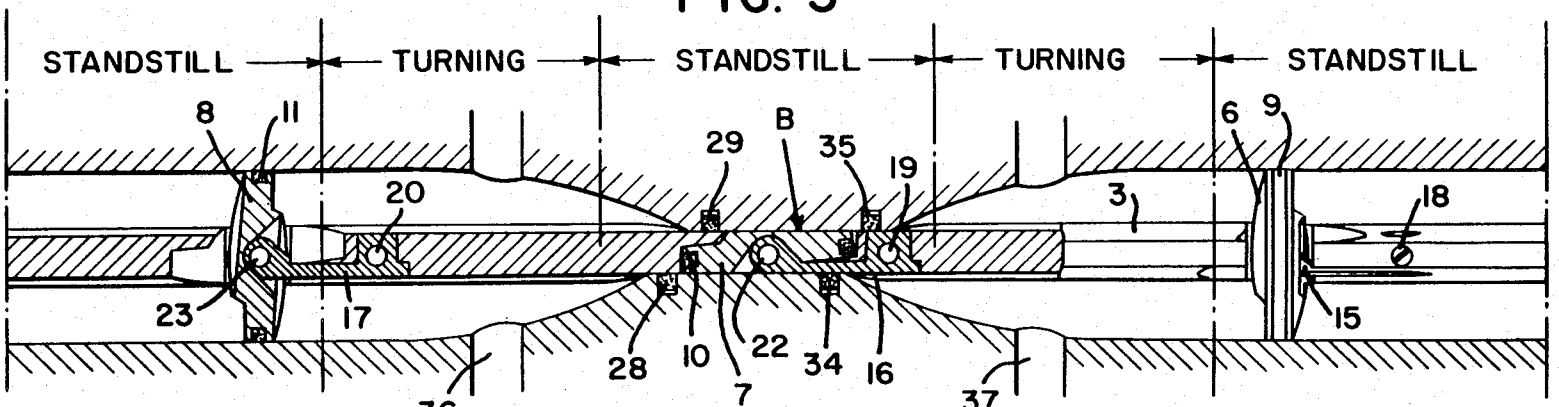

In the toroidal cylinder halves (1, 2) are the bearings 4 and 5 provided with oil seals 30 and 31. Further, for one vane such as at the lower bottom part of FIG. 2, annular seals 28 and 29 and blade springs 34 and 35 (for sealing the restriction) are shown. The inlet and outlet ports of the pressure medium conduits have reference numerals 36 and 37 in FIG. 3. In FIG. 3 especially, the rotation of the vanes around the vane axes 21, 22 and 23 is indicated when the vanes pass the restricted section B of the cylindrical casing (1, 2). At the upper side in FIG. 3 further in this embodiment is shown the division of the periodical movements of the vanes over 360° rotation of disc rotor 3.

In the right hand part of FIG. 3 the vane is shown in an upper view while in the left hand part and central part a section is drawn. Vane 8 with sealing spring 11 has passed, at the left hand part through the rotation range of 70° and is now in the position that the cylindrical casing is sealed by the vane. Because of the construction of two recessed walls in the opening of for the vanes in the disc rotor 3 the restriction B may be made shorter and therefore the effective period of operation of the vanes longer. In the restricted part (B) the vane 7 is rotated and by means of the dot-dash line through the vane axis 22 it is indicated that the vane is still making a small angle with the axis of the rotor disc, which angle is about 5°. This angle is also to be seen in the left hand vane drawn in FIG. 3, at the left hand part. Thus the vane is not rotating over the full 90° in respect of the sealing position.

Figure 4:
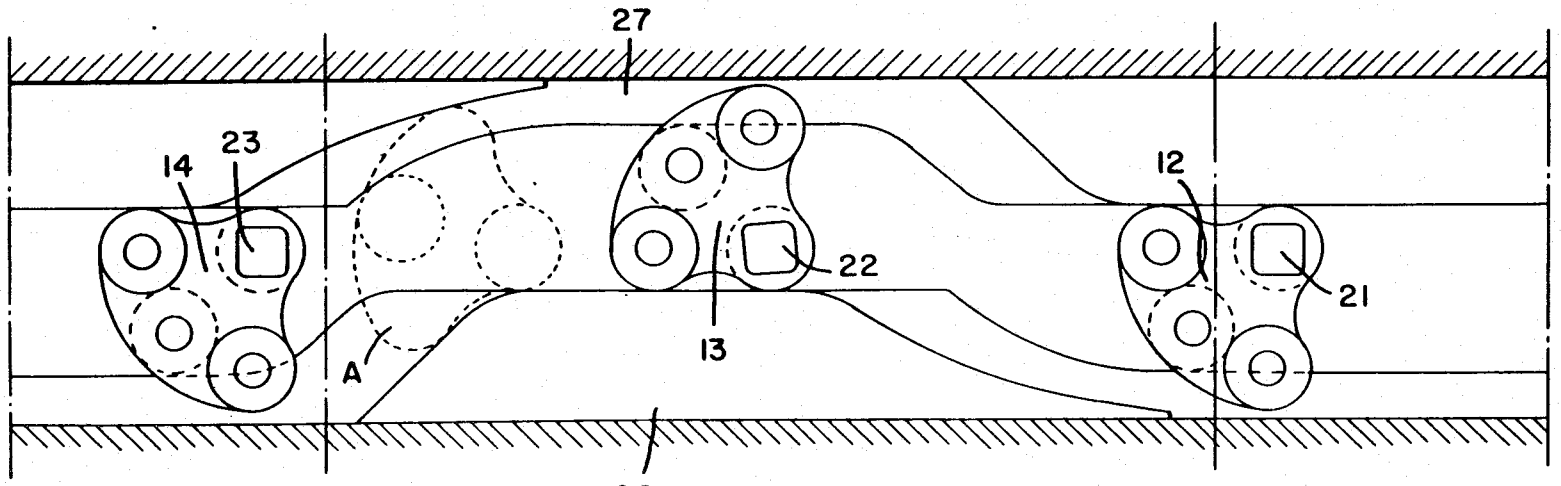
FIG. 4 is a 360° longitudinal section in flattened position along the curved disc with rockers, wherein the double curved disc is visible as well as the positions of the rockers.
Figure 5:
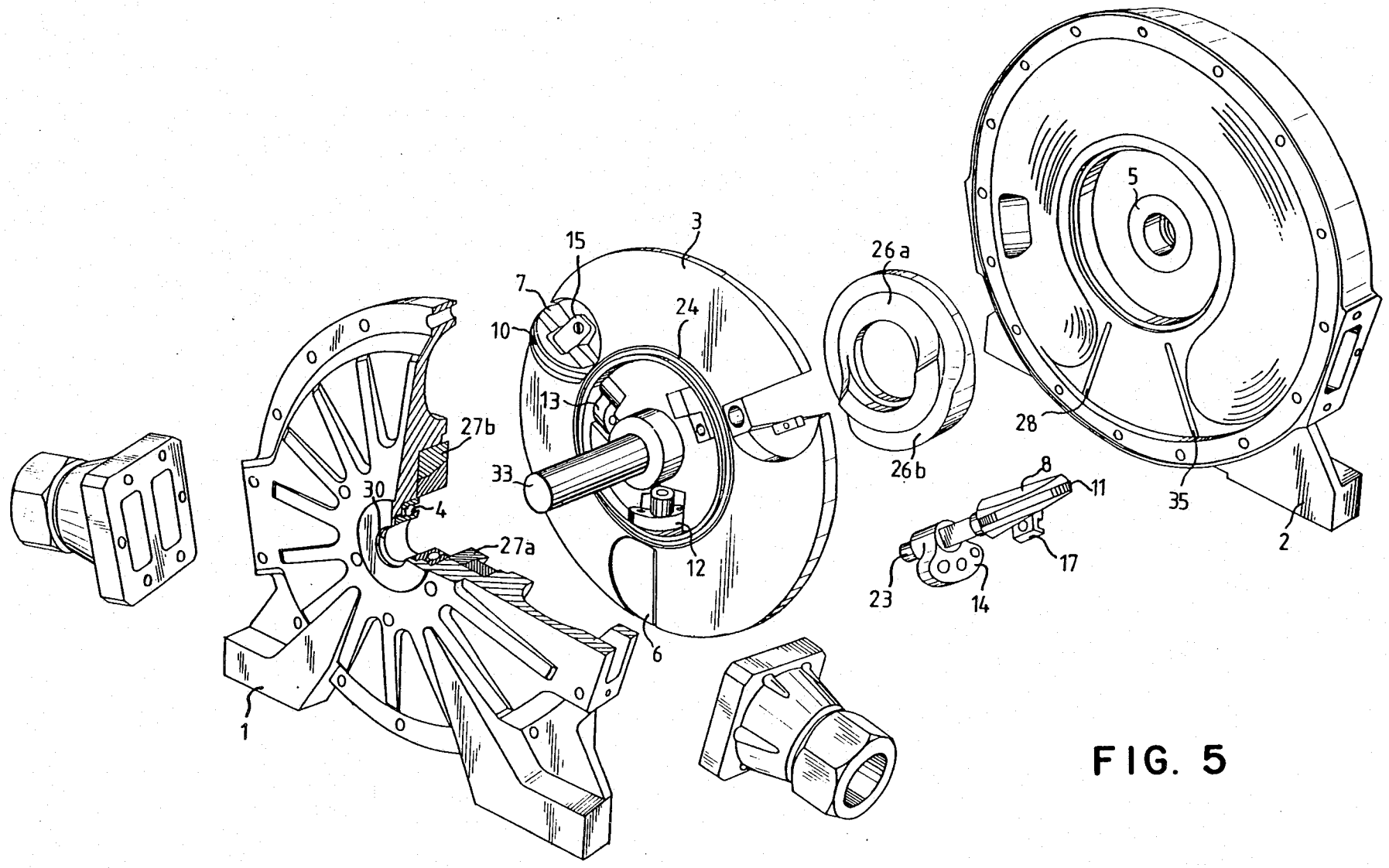
FIG. 5 is an exploded perspective view of the toroidal motor or pump illustrated in FIGS. 1 through 4.

In FIG. 4 the movement of the rockers (12, 13, 14) over the curved discs 26 and 27 is further illustrated. The three rockers are indicated in the position as drawn, corresponding to FIG. 3 with the same position of the vanes, but on an enlarged scale. It is to be understood that for a larger motor the rocker may also be carried out with three rollers. Further, as best seen in FIG. 5 each of curved discs 26, 27 includes two cam tracks defined by walls 26*a*, 26*b* and 27*a*, 27*b*, respectively.

The drawn lines at the upper and lower part give the twin recessed shape of the curved discs, the right hand part corresponding to the condition wherein the vane is sealing the cylinder. It is clear that the curved discs 26 and 27 are complementary, i.e. opposite the recesses are elevations. The rockers are always enclosed between the curves of the curved discs. Owing to the fact that the vane does not need to rotate the full 90°, the rotary traject may be chosen somewhat longer and the restricted range somewhat smaller.

By means of one of the pipelines 36 or 37 shown in FIG. 3, in practice a pressure medium is introduced, such as steam, but also pressurized air or a liquid which may again escape through the other lines can be used. If 36 is chosen as an inlet part then on vane 8, see FIG. 3, a pressure is exerted by which it, in the condition that the cylindrical casing is sealed, is moving towards the left hand side over a range of arc to 150° of standstill, as shown in FIG. 3, wherein the rockers are moving in the track of the curved disc, no forces being exerted on the rockers. In the 70° standstill track, as indicated in FIG. 3, the corresponding rocker is rotated by the curved disc and vane 6 is tilted and moved in a flat position through the restriction. It is irrelevant whether the pressure medium is introduced through 36 or 37 since the movement system of the vanes driven by the rockers can take place in both directions.

The toroidal motor/pump according to the invention always permits a smooth movement of the rockers wherein these on at least one moment in the periodical movement are taken up from the one curved track into the other.

The schematically shown dotted rocker A in FIG. 4 presents the transfer from the one curve into the other.

The motor/pump was tested as an air motor and it appears to possess an improved efficiency compared with other air motors which is about two times as large expressed in $m^3$/min air.

I claim:

1. Toroidal motor or pump comprising: a casing defining a toroidal passage; a disc rotor rotatably carried in said casing and extending into said toroidal passage; a plurality of vanes carried on shafts radially rotatably mounted on said rotor and which vanes are able to seal off the toroidal passage; rockers secured to the vane shafts and which during rotation of the motor or pump are carried between a pair of curved discs; said toroidal passage includes a narrowed section in the shape of the cross section of the disc rotor and through which the vanes when in a first position are able to pass; an inlet and an outlet port for a pressure medium and positioned in a section of said casing wherein the vanes are rotatable to a second position; said curved discs spaced from each other to define a cylindrical cam having a first curved track and a second curved track along which the rockers are carried; said rockers including a central cam follower and two side cam followers shaped so that the rockers are able to move through spaces in the disc rotor, said side cam followers engaging said first curved track and said central cam follower engaging said second curved track for pivoting said vanes within said toroidal passage.

2. A toroidal motor or pump according to claim 1, wherein at least at one moment in the periodical movement of the rockers contact between the cam followers of the rockers and the curved tracks of the cylindrical cam is transferred from said first curved track to said second curved track.

3. A toroidal motor or pump according to claim 1, wherein the vanes are provided with central supporting bearings which are carried in the disc rotor and the vanes are provided with circumferential annular sealings to sealingly engage said toroidal passage.

4. A toroidal motor or pump according to claim 1, wherein the narrowed section is constructed in such a way that in the first position of a vane, the vane is rotated less than 90° and is inclined relative to the narrowed section.

5. A toroidal motor or pump according to claim 4, wherein the vane is rotatable over about 85°.

6. A toroidal motor or pump comprising: a casing defining a toroidal passage; a disc rotor rotatably carried in said casing and extending into said toroidal passage; a plurality of vanes carried on shafts radially rotatably mounted on said rotor and which vanes are able to seal off the toroidal passage; rockers secured to the vane shafts and which during rotation of the motor or pump are carried between a pair of curved discs; said toroidal passage includes a narrowed section in the shape of the cross section of the disc rotor and through which the vanes when in a first position are able to pass, wherein the narrowed section is constructed in such a way that in the first position of a vane, the vane is rotated less than 90° and is inclined relative to the narrowed section; an inlet and an outlet port for a pressure medium and positioned in a section of said casing wherein the vanes are rotatable to a second position; said curved discs spaced from each other to define a cylindrical cam having a first curved track and a complementary second curved track along which the rockers are carried; said rockers including a central cam follower with two side cam followers shaped so that the rockers are able to move through spaces in the disc rotor, said cam followers engaging said cylindrical cam for pivoting said vanes within said toroidal passage; wherein the curved discs include two additional walls to define third and fourth curved tacks in said cam and are arranged so that a vane receiving opening in the rotor disc may be made smaller.

7. A toroidal motor or pump according to claim 6, wherein at least at one moment in the periodical movement of the rockers contact between the cam followers of the rockers and the curved tracks of the cylindrical cam is transferred from said first curved track to said second curved track.

8. A toroidal motor or pump according to claim 6, wherein the vane is rotatable over about 85°.

9. A toroidal motor or pump according to claim 6, wherein the vanes are provided with central supporting bearings which are carried in the disc rotor and the vanes are provided with circumferential annular sealings to sealingly engage said toroidal passage.

* * * * *